United States Patent [19]

Jakobi

[11] 4,456,505

[45] Jun. 26, 1984

[54] COKING OVEN WITH HORIZONTAL CHAMBERS FOR PRODUCING COKE

[75] Inventor: Wilhelm Jakobi, Essen, Fed. Rep. of Germany

[73] Assignee: Krupp-Koppers GmbH, Essen, Fed. Rep. of Germany

[21] Appl. No.: 433,808

[22] Filed: Oct. 8, 1982

[30] Foreign Application Priority Data

Oct. 31, 1982 [DE] Fed. Rep. of Germany ..... 3143248

[51] Int. Cl.[3] ..... C10B 25/24; C10B 29/02

[52] U.S. Cl. ..... 202/133; 202/251; 202/262

[58] Field of Search ..... 202/133, 250, 251, 247, 202/262, 263

[56] References Cited

U.S. PATENT DOCUMENTS

| | | | |
|---|---|---|---|
| 1,460,828 | 7/1923 | Schafer | 202/250 |
| 1,785,748 | 12/1930 | Van Ackeren | 202/263 |
| 2,100,758 | 11/1937 | Van Ackeren | 202/251 |
| 2,129,658 | 9/1938 | Drehschmidt | 202/263 |
| 2,249,056 | 7/1941 | Soulary | 202/251 |
| 4,176,994 | 12/1979 | Sangster | 202/262 |

FOREIGN PATENT DOCUMENTS

| | | | |
|---|---|---|---|
| 446397 | 6/1927 | Fed. Rep. of Germany . | |
| 523263 | 4/1931 | Fed. Rep. of Germany | 202/251 |

*Primary Examiner*—Bradley Garris

*Attorney, Agent, or Firm*—Michael J. Striker

[57] ABSTRACT

In a coking oven with a horizontal chamber the chamber is provided with a filling hole having a cylindrical portion with the diameter D and a reduced portion downwardly extending therefrom into the chamber over the height H. The ratio between D and H≦1.5.

2 Claims, 4 Drawing Figures

COKING OVEN WITH HORIZONTAL CHAMBERS FOR PRODUCING COKE

BACKGROUND OF THE INVENTION

The present invention relates to a coking oven of the type having horizontal chambers.

The coking ovens of the type under consideration are normally provided with a number of filling holes for charging coking coal into the chambers of the oven. The width of the chamber in the region of a gas collecting space thereof is decreased upwardly.

The plate closing the chamber of the coking oven battery is usually composed of a brick of a single format so that the whole width of the corresponding chamber is overbridged. The formation of the arch for the bridging is not allowed because in this case it is impossible to practically realize a support for a simultaneous arrangement of the required expansion joint for heat expansion absorption and the retention of the oven spacing. This is particularly difficult when the chambers having the width larger than 500 mm, for example 800 mm, are employed.

The chamber plate must be composed of a single brick format the length of which E and the height of which G are in the relationship with one another amounted to E:G=2.6; in such case the manufacturing possibilities with silica bricks usually utilized in the ovens of the type under discussion are limited to the length of 700 mm.

When it is necessary to use the ovens with chambers having a width of about 800 mm the production of plates causes certain difficulties. It has been suggested as an alternative to provide a constriction or a reduced portion in the chamber in the upper region thereof, or in the region of so-called gas collecting space. Such an arrangement has been disclosed in the German patent DE-PS No. 446397. The cross-section and the shape of the filling hole must be sufficient to ensure a quick and troubleless charging of the chamber with coal. The above-mentioned reduced portion in the upper region of the chamber presents, however an obstacle for the satisfactory coal charging.

SUMMARY OF THE INVENTION

It is an object of the invention to provide a coke oven which avoids the above disadvantages of the prior art.

It is another object of the invention to provide an improved coking oven with horizontal-type chambers.

These and other objects of the invention are attained by a coking oven with horizontal chambers each provided with a filling hole formed in the oven above the respective chamber for feeding the chambers with coking coal, each chamber having in the region of gas collection a width which is gradually reduced in the upward direction towards said filling opening, comprising a plurality of plates each disposed at the top of the respective chamber, said plates each being formed of single brick format extending normal to the direction of elongation of the respective chamber, each plate being formed with an opening consitituting a lower portion of the filling hole and having a rectangular cross-section with a cross-sectional area defined by $B \times C$ wherein B is one side of the rectangle and corresponds to the width of the respective chamber at the apex of the chamber and C is another side of the rectangle, said filling hole having a first cylindrical portion with a diameter D and a second portion, said first portion merging into said second portion, said second portion extending upwardly from said opening of the plate over the height H and having a cross-section which is gradually reduced in the direction of the side C and enlarged in the direction of side B over the height H upwardly toward said first cylindrical portion.

According to a further feature of the invention the ratio between D and H is $D:H \leqq 1.5$.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
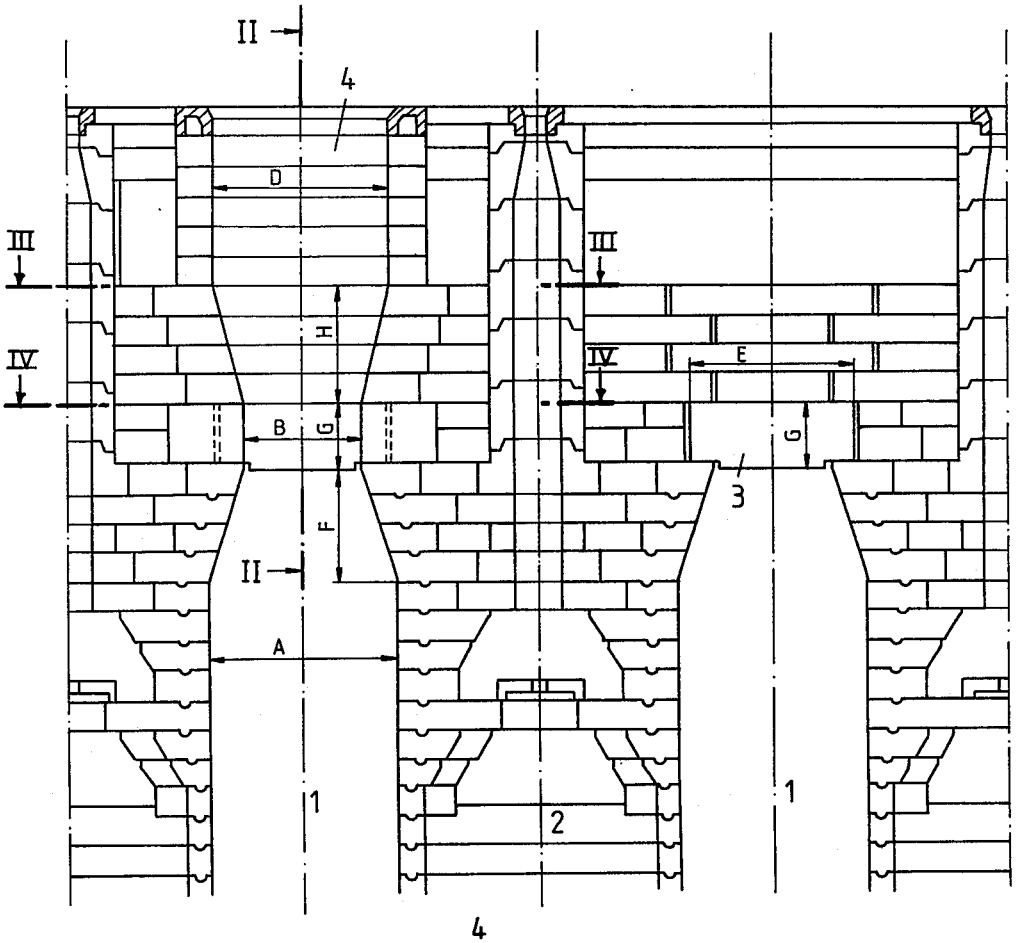
FIG. 1 is a partial lengthwise sectional view through a coking oven battery according to the invention.

Referring now to the drawings, and first to FIG. 1 two chambers 1 of the coking oven are shown formed between thermal wlls identified by reference character 2. Each chamber has a width A which is narrowed in the upward direction towards the apex of the chamber over the height F to the width B. This width reduction renders it possible (as shown in the righthand side of FIG. 1) that a plate 3 can be formed of a single brick format having the length E and height G.

Figure 2:
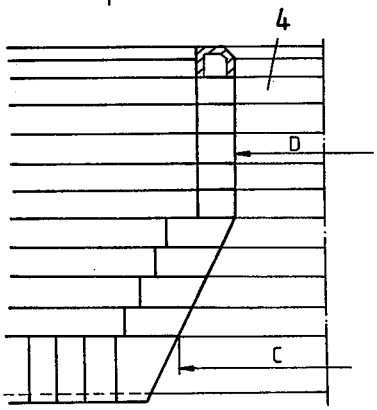
FIG. 2 is a section along line II—II of FIG. 1.
Figure 3:
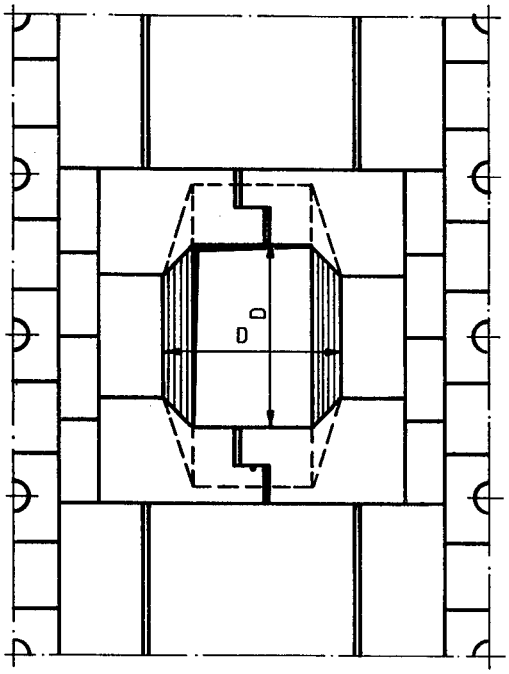
FIG. 3 is a section along line III—III of FIG. 1.
Figure 4:
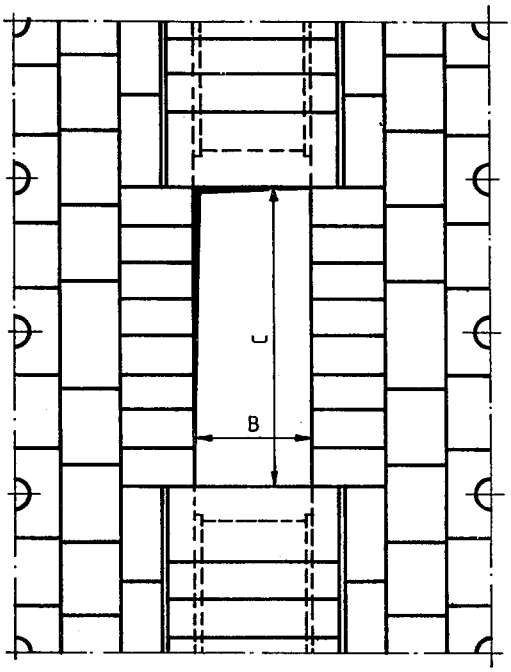
FIG. 4 is a section along line IV—IV of FIG. 1.

In order to provide a filling opening in the oven the rectangular cross-section-hole is formed in the plate 3 to release a through passage for coke; the hole has the width B corresponding to the reduced width of the chamber and the length C clearly seen in FIG. 2. The filling opening has a reduced cross-section portion extending through the height H upwardly of the plate 3 up to the cylindrical portion which has the diameter D whilst dimension C tends to be smaller and dimension B tends to be larger.

The shape of the filling opening is thus constituted due to the dimension relationship of the filling opening, which is defined by the ratio $B \times C$ is greater than $(\pi D^2/4)$ and the ratio D:H is smaller than or equal to 1.5; due to such a relationship the troubleless filling process is warranted despite of the constriction of the oven chamber.

It will be undersood that each of the elements described above, or two or more together, may also find a useful application in other types of coking ovens differing from the types described above.

While the invention has been illustrated and described as embodied in a coking oven, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In a coking oven with horizontal chambers each provided with a filling hole formed in the oven above the respective chamber for feeding the chambers with coking coal, each chamber having in the region of gas collection a width which is gradually reduced in the upward direction towards said filling opening, a combination comprising a plurality of plates each disposed at the top of the respective chamber, said plates each being formed of single brick format extending normal to the direction of elongation of the respective chamber, each plate being formed with an opening constituting a lower portion of the filling hole and having a rectangular cross-section with a cross-sectional area defined by $B \times C$, wherein B is one side of the rectangle and corresponds to the width of the respective chamber at the apex of the chamber and C is another side of the rectangle, said filling hole having a first cylindrical portion with diameter D and a second portion, said first portion merging into said second portion, said second portion extending upwardly from said opening of the plate over the height H and having a cross-section which is gradually reduced in the direction of the side C and enlarged in the direction of side B over the entire height H upwardly toward said first cylindrical portion up to diameter D.

2. The coking oven as defined in claim 1, wherein the ratio between D and H is smaller than or equal to 1.5.

* * * * *